US009488143B2

(12) United States Patent
Siewert et al.

(10) Patent No.: US 9,488,143 B2
(45) Date of Patent: Nov. 8, 2016

(54) FUEL INJECTOR

(71) Applicant: Robert Bosch GmbH, Stuttgart (DE)

(72) Inventors: Bernd Siewert, Stuttgart (DE); Frank Stadler, Stuttgart-Feuerbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/438,664

(22) PCT Filed: Sep. 26, 2013

(86) PCT No.: PCT/EP2013/070066

§ 371 (c)(1),
(2) Date: Apr. 27, 2015

(87) PCT Pub. No.: WO2014/063898

PCT Pub. Date: May 1, 2014

(65) Prior Publication Data

US 2015/0252766 A1 Sep. 10, 2015

(30) Foreign Application Priority Data

Oct. 26, 2012 (DE) ..... 10 2012 219 654

(51) Int. Cl.
*F02M 61/14* (2006.01)
*F02M 61/16* (2006.01)

(52) U.S. Cl.
CPC ..... *F02M 61/14* (2013.01); *F02M 61/166* (2013.01); *F02M 2200/858* (2013.01)

(58) Field of Classification Search
CPC ..... F02M 2200/858; F02M 61/14; F02M 61/166
USPC ..... 123/470
See application file for complete search history.

(56) References Cited

U.S. PATENT DOCUMENTS 3,695,235 A * 10/1972 Anderson ..... F02M 53/04 239/533.1
4,294,215 A 10/1981 Hans et al.
7,383,818 B1 * 6/2008 Beardmore ..... F02M 61/14 123/470

(Continued)

FOREIGN PATENT DOCUMENTS

DE 10108194 8/2002
DE 10108195 8/2002

(Continued)

OTHER PUBLICATIONS

International Search Report for Application No. PCT/EP2013/070066 dated Nov. 15, 2013 (English Translation, 3 pages).

*Primary Examiner* — Sizo Vilakazi
(74) *Attorney, Agent, or Firm* — Michael Best & Friedrich LLP

(57) ABSTRACT

The invention relates to a fuel injector (10), particularly a common rail fuel injector, with a valve housing (11) that can be inserted into a receiving opening (106) of a cylinder head (100) in an internal combustion engine and, when in the installed position, has a first valve housing section (12) facing a combustion chamber (101) in the internal combustion engine. The first valve housing section (12) is made of metal and is radially surrounded on the side facing the combustion chamber (101) by a sealing element (20) that can be inserted into the annular space between the first valve housing section (12) and the receiving opening (106) in the region of a first receiving bore section (107).

12 Claims, 1 Drawing Sheet

(56) References Cited

U.S. PATENT DOCUMENTS

| | | | | |
|---|---|---|---|---|
| 2003/0168533 | A1* | 9/2003 | Hans | F02M 51/0671 239/587.1 |
| 2004/0040543 | A1* | 3/2004 | Mickelson | F02M 61/14 123/470 |
| 2004/0050972 | A1 | 3/2004 | Winter | |
| 2004/0060544 | A1* | 4/2004 | Reiter | F02M 61/14 123/470 |

FOREIGN PATENT DOCUMENTS

| | | |
|---|---|---|
| DE | 10125943 | 12/2002 |
| JP | 2008064204 | 3/2008 |

* cited by examiner

FUEL INJECTOR

BACKGROUND OF THE INVENTION

The invention relates to a fuel injector, in particular common rail injector, with a valve housing which can be inserted into a receiving opening of a cylinder head of an internal combustion engine and, in the installed position, has a first valve housing portion facing a combustion chamber of the internal combustion engine, wherein the first valve housing portion is composed of metal and, on the side facing the combustion chamber, is surrounded radially by a sealing element which can be inserted into the annular space between the first valve housing portion and the receiving opening in the region of a first receiving bore portion.

Such a fuel injector which is known in practice serves for injecting fuel into the combustion chamber of an internal combustion engine. For this purpose, the internal combustion engine has, in the region of a cylinder head bounding the combustion chamber, a receptacle in the form of a stepped bore, into which the fuel injector is inserted by the valve housing thereof. The fuel injector projects here with at least one nozzle opening into the combustion chamber of the internal combustion engine. In order to seal the combustion chamber or the cylinder head to the outside, the injector housing of the fuel injector is customarily accommodated in the receiving bore of the cylinder head with the interposition of a nozzle sealing disk and with axial prestress. During the operation of the internal combustion engine, the combustion chamber has the highest temperature, the temperature gradually decreasing in the cylinder head or in the receiving bore on the side facing away from the combustion chamber, depending on the distance from the combustion chamber. In an analogous manner, the temperature of the fuel injector or of the valve housing thereof likewise decreases at an increasing distance from the combustion chamber. In particular in the case of relatively low combustion chamber temperatures or at a relatively large distance from the combustion chamber, the formation of condensate on the valve housing of the fuel injector may occur, inter alia assisted, for example, by sulfurous fuel or by water arising during the combustion of the fuel. Since the valve housing in the cylinder head is sealed toward the outside via the nozzle sealing disk, especially the region axially just below the nozzle sealing disk in the region of a first receiving bore portion of the cylinder head is affected by this since, as seen relatively, the lowest temperatures prevail there. The formation of condensate may result in corrosion of the valve housing occurring in the region discussed, the corrosion, as considered over the service life of the fuel injector, possibly leading to an impairment of the operability of the fuel injector.

In the case of the fuel injector which is known in practice and is used in spark-ignition internal combustion engines (gasoline engines), it is therefore known to provide a sealing element which is composed of plastic and which radially surrounds the valve housing on the side facing the combustion chamber close to the combustion chamber such that the penetration of the condensate in the direction of that side of the fuel injector which faces away from the combustion chamber is at least made difficult. The known sealing element is inserted in a radially encircling annular groove of the valve housing. On transfer to a compression-ignition internal combustion engine (diesel engine), such a solution is not expediently possible since the higher pressures prevailing in the fuel injector (in comparison to the pressures in an injector for a spark-ignition internal combustion engine) cause a weakening of the valve housing by the annular groove, which would lead to a functional impairment, As an alternative thereto, the valve housing would have to have a greater wall thickness, which, for a wide variety of reasons, is neither desirable nor possible in practice since, for example, the diameter of the receiving bore for the fuel injector is predetermined in the region of the valve housing.

Furthermore, DE 101 25 943 A1 discloses a fuel valve for internal combustion engines, in which the valve housing portion facing the combustion chamber is surrounded by a sleeve. However, the sleeve known from the document mentioned serves solely and only for increasing the strength of the valve housing.

SUMMARY OF THE INVENTION

Starting from the depicted prior art, the invention is based on the object of developing a fuel injector, in particular a common rail injector for use in compression-ignition internal combustion engines, as discussed above, in such a manner that, with the use of a sealing element as is known in spark-ignition internal combustion engines, a structurally at least substantially unchanged, i.e. conventional, valve housing can be used. This object is achieved according to the invention in the case of a fuel injector in that the sealing element is positioned on the first valve housing portion in the axial direction by means of an additional element embodied as a separate component. In contrast to the prior art, it is therefore not required, by means of an annular groove or the like, to provide the valve housing with an associated weakening of the valve housing or with an increased wall thickness.

In a structurally preferred embodiment of the additional element that can be realized particularly simply in terms of production, it is proposed that the additional element is embodied in the form of a sleeve which surrounds the first valve housing portion radially, preferably with a small gap. Furthermore, such an embodiment has the particular advantage that the sleeve can act in the manner of a protective element where, if condensate is present, the sleeve first of all serves as a type of "sacrificial element" before the condensate can act on the actual valve housing should the sealing element fail.

In order to maximize the mentioned protective function of the sleeve and to protect the valve housing as far as possible over the entire length thereof from the condensate, it is furthermore provided that the sleeve, on the side facing the combustion chamber, reaches in the first receiving bore portion virtually as far as the combustion chamber and, on the side facing away from the combustion chamber, reaches as far as a second valve housing portion which adjoins the first valve housing portion and has a larger diameter in comparison to the first valve housing portion.

Furthermore, it is particularly preferred in the last-mentioned embodiment if the sleeve, on the side facing away from the sealing element, has an edge region which encircles the sleeve in a flange-shaped manner and on which, in the installed position, the end side of the second valve housing portion rests, and if the edge region from which the first receiving bore portion emerges rests on a step of the receiving opening. In such a configuration, the nozzle sealing disk customarily used in the prior art can optionally be dispensed with and, by means of the formation of the edge encircling in a flange-shaped manner, a particularly secure contact or support of the fuel injector in the receiving bore of the cylinder head and the possibility of particularly simple installation of the sleeve into, and removal of the sleeve from, the receiving opening are made possible.

For the situation in which the sleeve is exposed to the condensate, it is expedient for the sleeve to be as resistant as possible to the condensate, i.e. not to be mechanically or chemically damaged by the action of the condensate. It is therefore provided, in a further refinement of the invention, that the sleeve is composed of an inert material, in particular stainless steel or plastic.

In order, firstly, to achieve as good a sealing effect of the sealing element as possible and, secondly, to avoid damaging of the sealing element over the service life of the fuel injector although the sealing element is in particular also exposed to relatively high combustion chamber temperatures, it is furthermore proposed that the sealing element is composed of plastic, in particular based on Viton, silicone or Teflon.

In particular, it is provided that the sealing element is arranged on that end side of the sleeve which faces the combustion chamber. As a result, it is ensured that the sealing element is the element which first of all enters into operative connection with the condensate when condensate occurs.

According to the invention, the connection between the plastic of the sealing element and the sleeve is preferably produced by the plastic of the sealing element being connected to the sleeve by injection molding onto the end side of the sleeve or by dipping of the sleeve in the liquefied plastic of the sealing element.

For the effect of the sealing element, it is particularly advantageous according to the invention if the sealing element seals the sleeve radially toward the first valve housing portion. As a result, it is ensured in particular that, when condensate occurs, the condensate does not enter into operative connection with the valve housing portion since the radial gap between the valve housing and the receiving opening of the sleeve is sealed by the sealing element.

Furthermore, it is particularly preferably provided that the sealing element bears radially in a sealing manner against the first receiving bore portion and thereby seals the radial region between the sleeve and the first receiving bore portion. It is thereby ensured that condensate also cannot enter the radially encircling gap between the receiving bore portion and the sleeve, and therefore the sleeve itself is also optimally protected from the action of the condensate.

BRIEF DESCRIPTION OF THE DRAWINGS

Further advantages, features and details of the invention emerge from the description below of preferred exemplary embodiments and with reference to the drawing.

In the drawing.

The same elements or elements having the same function are provided with the same reference numbers in the figures.

DETAILED DESCRIPTION

Figure 1:
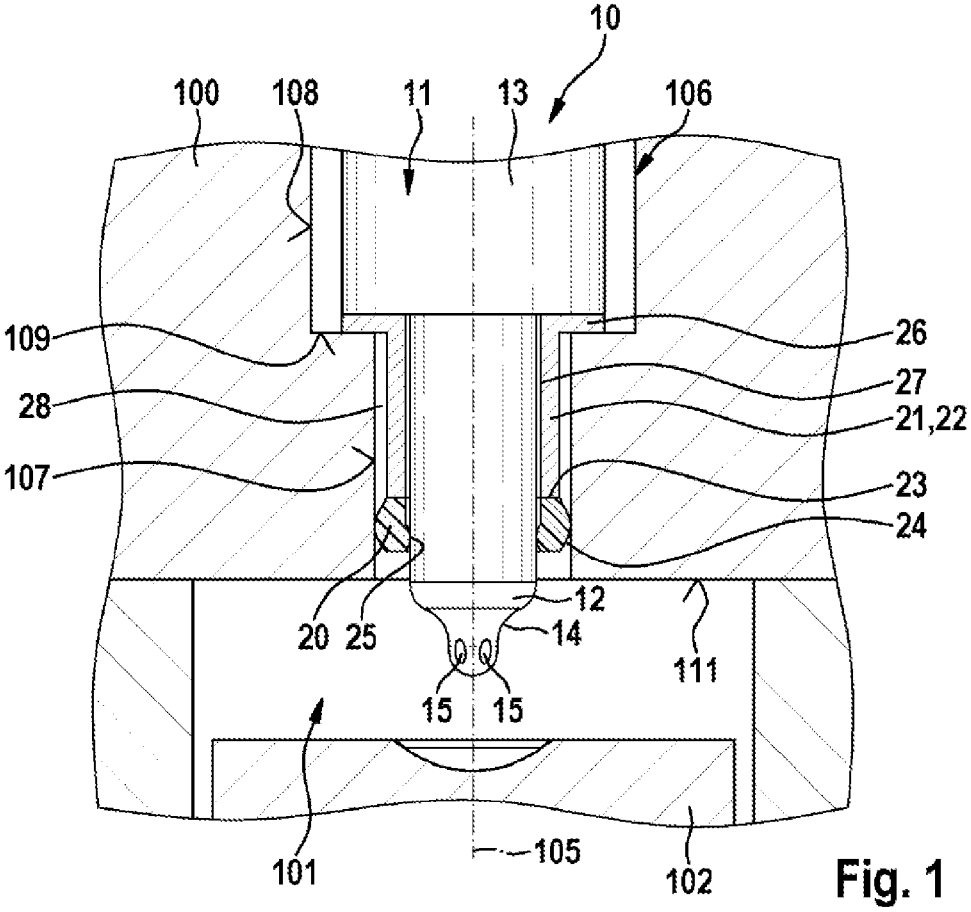
FIG. 1 shows an illustration of a lower part of a fuel injector according to the invention in which the latter is arranged in a cylinder head of an internal combustion engine.
Figure 2:
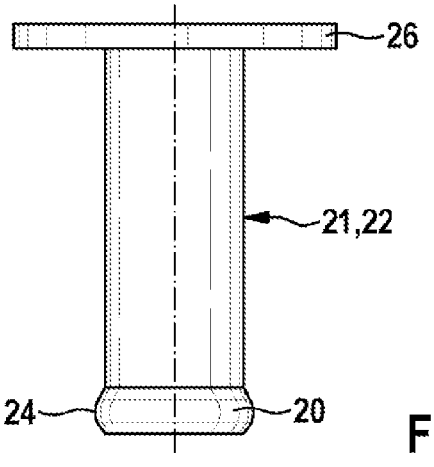
FIG. 2 shows a sleeve used for use in the fuel injector according to FIG. 1 with a sealing element connected to said sleeve, in a side view.

FIG. 1 illustrates part of the upper region of a compression-ignition internal combustion engine together with the cylinder head 100 thereof. The cylinder head 100 bounds a combustion chamber 101 of the internal combustion engine, in which a piston 102 is arranged so as to be movable up and down in the customary manner in the direction of a longitudinal axis 105.

In order to receive a fuel injector 10 according to the invention, which is embodied in particular as a common rail injector, the cylinder head 100 has a receiving opening 106 in the form of a stepped bore. On the side facing the combustion chamber 101, the receiving opening 106 has a first receiving bore portion 107 which is adjoined on the side facing away from the combustion chamber 101 by a second receiving bore portion 108. The two receiving bore portions 107, 108 are connected to each other via a radially encircling step 109, wherein the first receiving bore portion 107 has a smaller diameter than the second receiving bore portion 108, and wherein the two receiving bore portions 107, 108 are preferably in each case of cylindrical design.

The fuel injector 10 which is illustrated in simplified form in FIG. 1 comprises a valve housing 11 which is composed of metal and has two integrally interconnected valve housing portions 12, 13. The first valve housing portion 12 has a smaller diameter than the second valve housing portion 13, wherein the two valve housing portions 12, 13 are preferably of cylindrical design. The first valve housing portion 12 is substantially arranged within the first receiving bore portion 107, and the second valve housing portion 13 is arranged within the second receiving bore portion 108. On the side facing the combustion chamber 101, the first valve housing portion 12 merges into a dome-like end region 14, in the wall of which is formed at least one nozzle opening 15 via which fuel can be injected into the combustion chamber 101 of the internal combustion engine. The fuel is injected in a manner which is known per se and is therefore not explained specifically because it is not essential to the invention, in particular by a nozzle needle which is arranged in the fuel injector 10 and is actuable by an actuator.

While the first valve housing portion 12 is arranged within the first receiving bore portion 107, the end region 14 of the valve housing 11 projects into the combustion chamber 101. The arrangement of the fuel injector 10 with respect to the combustion chamber 101 or with respect to the longitudinal axis 105 is, for example, parallel to the longitudinal axis 105, but can also be provided obliquely with respect to the longitudinal axis 105.

During the operation of the internal combustion engine, a relatively high temperature of, for example, several 100° C. prevails within the combustion chamber 101, said temperature being transmitted to the cylinder head 100 and to the fuel injector 10, wherein the temperature in the receiving opening 106 of the first receiving bore portion 107 decreases in the direction toward the second receiving bore portion 108. In order to avoid the valve housing 11 being damaged by corrosion, as considered over the operating duration of the fuel injector 10, in the region of the first valve housing portion 12, in particular in the transition region to the second valve housing portion 13, in which, as seen relatively, the lowest temperatures prevail, it is provided according to the invention that the first valve housing portion 12 is surrounded radially by a sealing element 20 within the first receiving bore portion 107.

As can be seen in particular with reference to FIG. 1, the sealing element 20 projects with respect to the longitudinal axis 105 virtually as far as that end of the first receiving bore portion 107 which faces the lower end surface 111 of the cylinder head 100. However, the sealing element 20 in no way projects into the combustion chamber 101. The sealing element 20 which is preferably composed of (heat-resistant)

plastic, preferably based on Viton, silicone or Teflon, is arranged or fastened on an additional element 21. The additional element 21 is embodied in the form of a sleeve 22 and is composed of an inert material, in particular stainless steel or plastic. The sealing element 20 is arranged or fastened on that end side 23 of the sleeve 22 which faces the combustion chamber 101. The sealing element 20 is fastened either by the sealing element 20 being injection molded onto the end side 23 of the additional element 21, for example, by means of plane elements arranged in the immediate region of the end side 23, or by the additional element 21 being dipped by the end side 23 thereof into the initially liquefied material of the sealing element 20 and, after the material has solidified, adhering to the end side 23.

It is advantageously provided that the sealing element 20 is preferably of spherical design both on the outer circumference 24 thereof and on the inner circumference 25 thereof in such a manner that the outer circumference 24 of the sealing element 20 bears in a sealing manner against the first receiving bore portion 107 while the inner circumference 25 of the sealing element 20 is in sealing bearing contact with the first valve housing portion 12.

The additional element 21 serves in particular for axially positioning the sealing element 20 on the outer side of the first valve housing portion 12. For this purpose, the additional element 21 has, on the end side opposite the sealing element 20, an edge region 26 which encircles in a flange-shaped manner and the outer diameter of which is dimensioned in such a manner that the edge region 26 rests axially on the step 109 of the receiving opening 106 and therefore at the same time forms a support surface for the second valve housing portion 13 of the valve housing 11. By means of a corresponding design of the edge region 26 (material, shape), it is possible optionally to dispense with a nozzle sealing disk which is customary in the prior art, wherein, in order to form the sealing of the combustion chamber 101, it is customarily provided that the fuel injector 10 is subjected to a force in the axial direction in the direction toward the combustion chamber 101, for example by means of a clamping claw (not illustrated) or the like.

The additional element 21 or the sleeve 22 surrounds the first valve housing portion 12 preferably with the formation just of a small radial gap 27. It is thereby ensured that simple installation of the fuel injector 10 on, or removal of same from, the sealing element 20 is made possible since sliding friction is formed between the sealing element 20 and the first valve housing portion 12, but the valve housing 11 itself can simply be introduced into the sleeve 22 or pulled out of same. Furthermore, the edge region 26 permits simple installation or removal of the sleeve 22.

The function of the sealing element 20 consists in particular in preventing condensate from being able to enter the annular gap 27 between the housing 22 and the first valve housing portion 12. The discussed sealing effect of the sealing element 20 between the inner circumference 25 thereof toward the first valve housing portion 12 serves for this purpose. Furthermore, by the outer circumference 24 of the sealing element 20 bearing tightly against the first receiving bore portion 107, condensate is also prevented from penetrating the annular region 28 between the first receiving bore portion 107 and the outer circumference of the sleeve 22. Should this nevertheless occur, the choice of material for the additional element 21 and the provision of the edge region 26 encircling in a flange-shaped manner result in protection of the first valve housing portion 12 by the condensate first of all having to penetrate the material of the additional element 21 before the material enters into contact with the first valve housing portion 12.

The fuel injector 10 described to this extent or the sealing element 20 thereof and the additional element 21 can be modified in diverse ways without deviating from the inventive concept. For example, it is conceivable to provide the sleeve 22 with openings or the like if the protective effect of the additional element 21 with respect to the first valve housing portion 12 is intended to be dispensed with. In this case, the additional element 21 serves merely as a positioning element for the axial positioning of the sealing element 20 on the first valve housing portion 12. It is also conceivable to connect the sleeve 22 to the first valve housing portion 12 by means of an interference fit or the like, for example by means of an adhesive connection. In this case, it is possible, for example, to dispense with the edge region 26 of the additional element 21 if, in the customary manner, a nozzle sealing disk is used. Finally, the sealing element 20 can also be arranged in the manner of two round seals radially on the outside and on the inside of the sleeve 22 in the region of the end side 23.

The invention claimed is:

1. A fuel injector (10), comprising a valve housing (11) which can be inserted into a receiving opening (106) of a cylinder head (100) of an internal combustion engine and, in an installed position, has a first valve housing portion (12) facing a combustion chamber (101) of the internal combustion engine and a second valve housing portion (13), wherein the second valve housing portion (13) adjoins the first valve housing portion (12) and has a larger diameter in comparison to the first valve housing portion (12), wherein the first valve housing portion (12) is composed of metal and is surrounded radially by a sealing element (20) which is configured to be inserted into an annular space between the first valve housing portion (12) and the receiving opening (106) in a region of a first receiving bore portion (107), wherein the sealing element (20) is positioned on the first valve housing portion (12) in an axial direction by an additional element (21) that is a separate component, wherein the additional element (21) is embodied in the form of a sleeve (22) which surrounds the first valve housing portion (12) radially, wherein the sleeve (22), on a side facing the combustion chamber (101), reaches in the first receiving bore portion (107) virtually as far as the combustion chamber (101) and, on a side facing away from the combustion chamber (101), reaches as far as the second valve housing portion (13), wherein the sleeve (22), on a side facing away from the sealing element (20), has an edge region (26) which encircles the sleeve in a flange-shaped manner and on which, in the installed position, an end side of the second valve housing portion (13) rests, and wherein the edge region (26) rests on a step (109) of the receiving opening (106).

2. The fuel injector as claimed in claim 1, characterized in that the sleeve (22) is composed of an inert material.

3. The fuel injector as claimed in claim 1, characterized in that the sealing element (20) is composed of plastic.

4. The fuel injector as claimed in claim 3, characterized in that the sealing element (20) is arranged in a region of an end side (23) of the sleeve (22) which faces the combustion chamber (101).

5. The fuel injector as claimed in claim 4, characterized in that the plastic of the sealing element (20) is connected to the sleeve (22) by injection molding onto the end side (23) of the sleeve (22).

6. The fuel injector as claimed in claim 1, characterized in that the sealing element (20) seals the sleeve (22) radially toward the first valve housing portion (12).

7. The fuel injector as claimed in claim 6, characterized in that the sealing element (20) bears radially in a sealing manner against the first receiving bore portion (107) and thereby seals a radial region (28) between the sleeve (22) and the first receiving bore portion (107).

8. The fuel injector as claimed in claim 1, characterized in that the additional element (21) is embodied in the form of a sleeve (22) which surrounds the first valve housing portion (12) radially with a small gap (27).

9. The fuel injector as claimed in claim 1, characterized in that the sleeve (22) is composed of stainless steel or plastic.

10. The fuel injector as claimed in claim 1, characterized in that the sealing element (20) is composed of plastic, based on Viton, silicone or Teflon.

11. The fuel injector as claimed in claim 4, characterized in that the plastic of the sealing element (20) is connected to the sleeve (22) by injection molding onto the end side (23) of the sleeve (22), by means of plane elements arranged in the region of the end side (23).

12. The fuel injector as claimed in claim 4, characterized in that the plastic of the sealing element (20) is connected to the sleeve (22) by injection molding onto the end side (23) of the sleeve (22), by dipping the sleeve (22) into liquefied plastic of the sealing element (20).

* * * * *